US007021980B2

(12) United States Patent
Hanai

(10) Patent No.: US 7,021,980 B2
(45) Date of Patent: Apr. 4, 2006

(54) ADJUSTING METHOD FOR CENTERING EARTH ELECTRODE AT CENTER ELECTRODE OF SPARK GAP OF SPARK PLUG

(75) Inventor: Takeshi Hanai, Kuwana (JP)

(73) Assignee: Denso Corporation, (JP)

( * ) Notice: Subject to any disclaimer, the term of this patent is extended or adjusted under 35 U.S.C. 154(b) by 232 days.

(21) Appl. No.: 10/674,391

(22) Filed: Oct. 1, 2003

(65) Prior Publication Data

US 2004/0067712 A1 Apr. 8, 2004

(30) Foreign Application Priority Data

Oct. 8, 2002 (JP) ..... 2002-295344

(51) Int. Cl.
*H01J 9/42* (2006.01)

(52) U.S. Cl. ..... 445/4; 445/7

(58) Field of Classification Search ..... 445/4, 445/7

See application file for complete search history.

(56) References Cited

U.S. PATENT DOCUMENTS 3,898,829 A * 8/1975 Sydow ..... 72/125

FOREIGN PATENT DOCUMENTS

JP 07-057849 * 3/1995
JP 2000-329529 11/2000

* cited by examiner

*Primary Examiner*—Joseph Williams
(74) *Attorney, Agent, or Firm*—Nixon & Vanderhye PC

(57) ABSTRACT

An object of the present invention is to efficiently adjust a positional difference (measured along the direction perpendicular to the center electrode axis) between the center electrode (CE) axis and the center of the earth electrode (EE). The CE tip and EE tip surface are illuminated from the front of the EE tip surface, thereby picking up their images. The image processing unit calculates the positional difference between the CE axis and EE center. Here, the EE center is defined by an area centroid of the EE tip surface area, thereby improving a measurement accuracy. The adjustment unit connected with the image processing unit causes the actual positional difference to decrease by moving EE by the that calculated positional difference, taking a prescribed spring-back into consideration. EE is moved by a jig moved by a screw rotated by a motor.

11 Claims, 5 Drawing Sheets

ADJUSTING METHOD FOR CENTERING EARTH ELECTRODE AT CENTER ELECTRODE OF SPARK GAP OF SPARK PLUG

BACKGROUND OF THE INVENTION

1. Field of the Invention

The present invention relates to an adjusting method for centering an earth electrode at an axis of a center electrode of a spark gap of a spark plug for an internal combustion engine mounted on a automotive vehicle.

2. Description of the Related Art

In conventional spark plugs, a columnar center electrode is fixed and electrically isolated in the spark plug housing, while one end of the earth electrode is welded to the housing and the other end of the earth electrode is bent perpendicular to the tip surface of the center electrode, thereby forming a spark gap.

The spark gap length is adjusted within a prescribed tolerance and further a positional difference (measured along a direction perpendicular to the axis of the center electrode) between the axis of the center electrode and the center of the end surface of the earth electrode is also adjusted within other prescribed tolerance. It is ideal that the off-axis positional difference is zero.

Although, for example, JP2000-329529A discloses a method for observing the spark gap, wherein an edge image of the center electrode and earth electrode is obtained by an oblique illumination surrounding them and the image is processed, there is not yet in the field of the image processing any established method for measuring the above-mentioned off-axis positional difference between the center electrode and earth electrode. Thus, the off-axis positional difference could not be efficiently adjusted.

SUMMARY OF THE INVENTION

An object of the present invention is to efficiently adjust a positional difference (measured along a direction perpendicular to the axis of the center electrode) between the center electrode axis and the center of the earth electrode.

The present invention is directed to an adjusting method for centering an earth electrode at a center electrode of a spark gap of a spark plug.

In the adjusting method of the present invention, an illuminating step is executed for illuminating said spark plug from a front of a surface of an end tip of said earth electrode.

Next, an image picking-up step follows for picking up a reflected image of said spark gap.

Next, a calculating step follows for calculating a center of the tip surface of said earth electrode and axis of said center electrode on the basis of said reflected image.

Next, a moving step follows for moving said earth electrode toward said axis.

Next, a measuring step follows for measuring a positional difference between said axis of said center electrode and center of said earth electrode along a direction perpendicular to said axis of said center electrode.

According to the present invention, the reflection illumination employed in the present invention enables to precisely measure and efficiently adjust the above-mentioned off-axis positional difference, although it was difficult to measure the above-mentioned off-axis positional difference by the transmitting illumination due to a leg portion of the earth electrode which stands up from the spark plug housing and hides the spark gap, the reflection illumination as employed in the present invention enables to precisely measure and efficiently adjust the above-mentioned off-axis positional difference.

Further, according to the present invention, the center position of the earth electrode is defined by an area center (area centroid) of said reflected image of said earth electrode, whereby the above-mentioned off-axis positional difference is more precisely obtained by the image processing process, although the conventional image processing by the edge processing method could not give a precise center position of the earth electrode, due to fluctuation of the cross sectional shape of the earth electrode.

Further, according to the present invention, the earth electrode is moved toward the center electrode axis, taking into consideration a spring-back which is caused after completing the adjustment step, thereby more precisely adjusting the above-mentioned off-axis positional difference.

PREFERRED EMBODIMENT OF THE INVENTION

Figure 1:
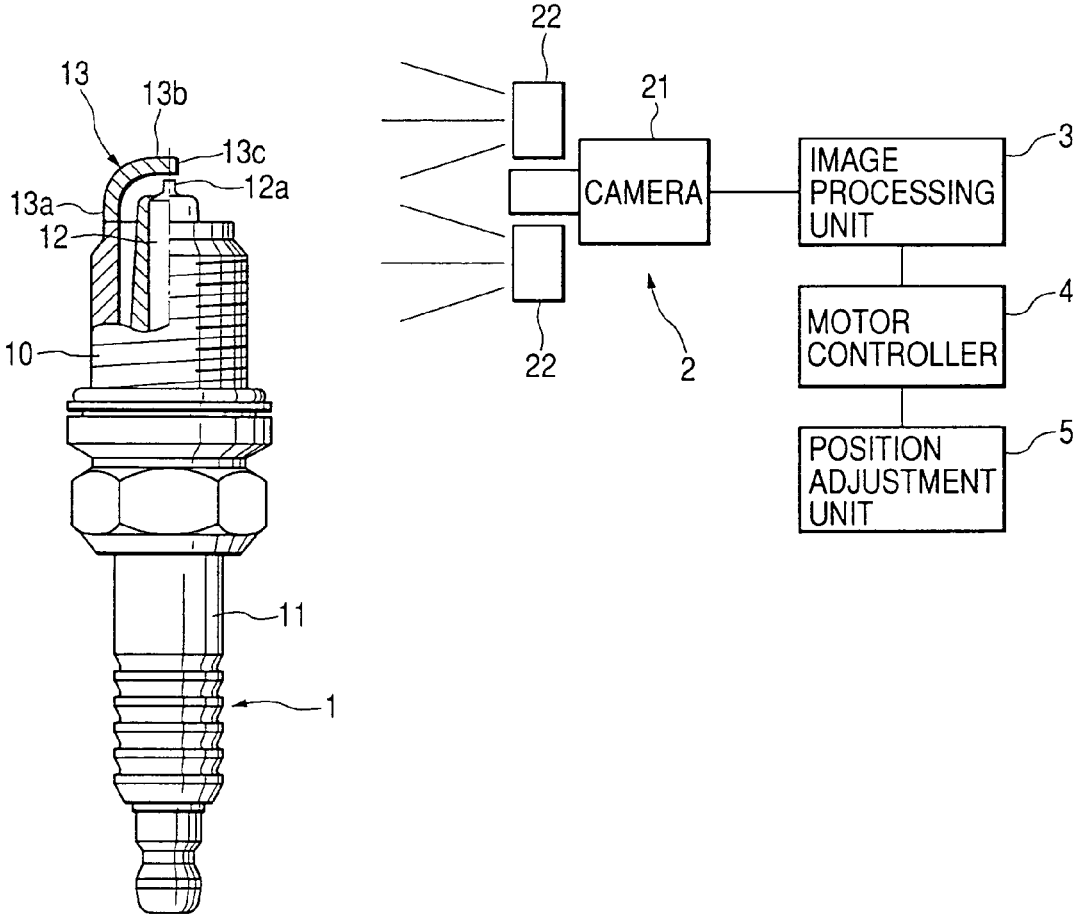
FIG. 1 is a block diagram of an apparatus for adjusting a spark gap, wherein a reflected image of the spark gap seen from a front of a tip surface of the earth electrode is inputted and processed.

Preferred embodiment is explained, referring to the drawings.

Figure 3:
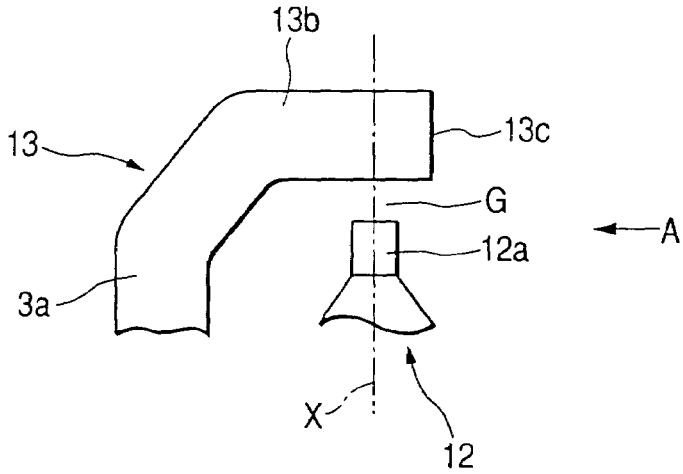
FIG. 3 is an enlarged partial elevational view of the spark plug around the center electrode and earth electrode.
Figure 4:
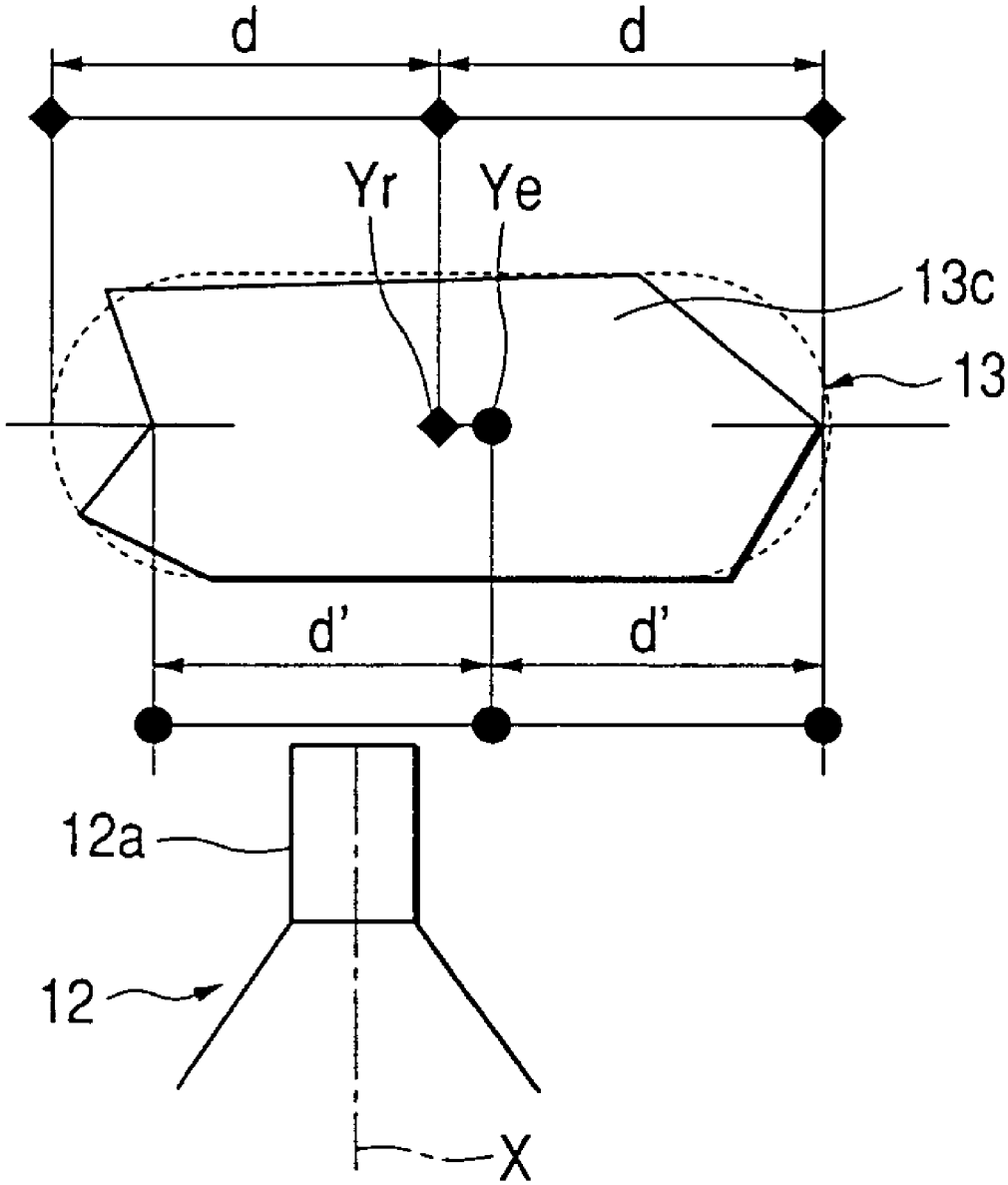
FIG. 4 is a side view of the spark plug as seen from direction "A" in FIG. 3.

A spark plug 1 as shown in FIG. 1 has a cyrindrical housing 10 into which a cylindrical ceramics insulator 11 is inserted and fixed therein. Further, a cylindrical center electrode 12 is inserted into a hole around the axis of the insulator 11 and fixed therein. Further, an earth electrode 13 made of Ni alloy is welded to the housing 10. The earth electrode 13 as shown in FIG. 3 comprises: a leg 13*a* extending parallel to the axis "X" of the center electrode 12; and an opposite portion extending perpendicular to the axis "X". A part of the leg 13*a* is welded to the housing 10. The opposite portion is disposed opposite to the tip 12*a* of the center electrode 12. A spark gap is formed between the tip 12*a* and opposite portion 13*b*.

An image pick-up unit 2 (comprising a CCD camera 21 and illumination device 22 as shown in FIG. 1) picks up an image of the electrodes 12 and 13. The picked-up image is sent to an image processing unit 3. The tip 12*a* and tip surface 13*c* of other end of the earth electrode 13 are illuminated from the front of the tip surface 13*c*.

Figure 5:
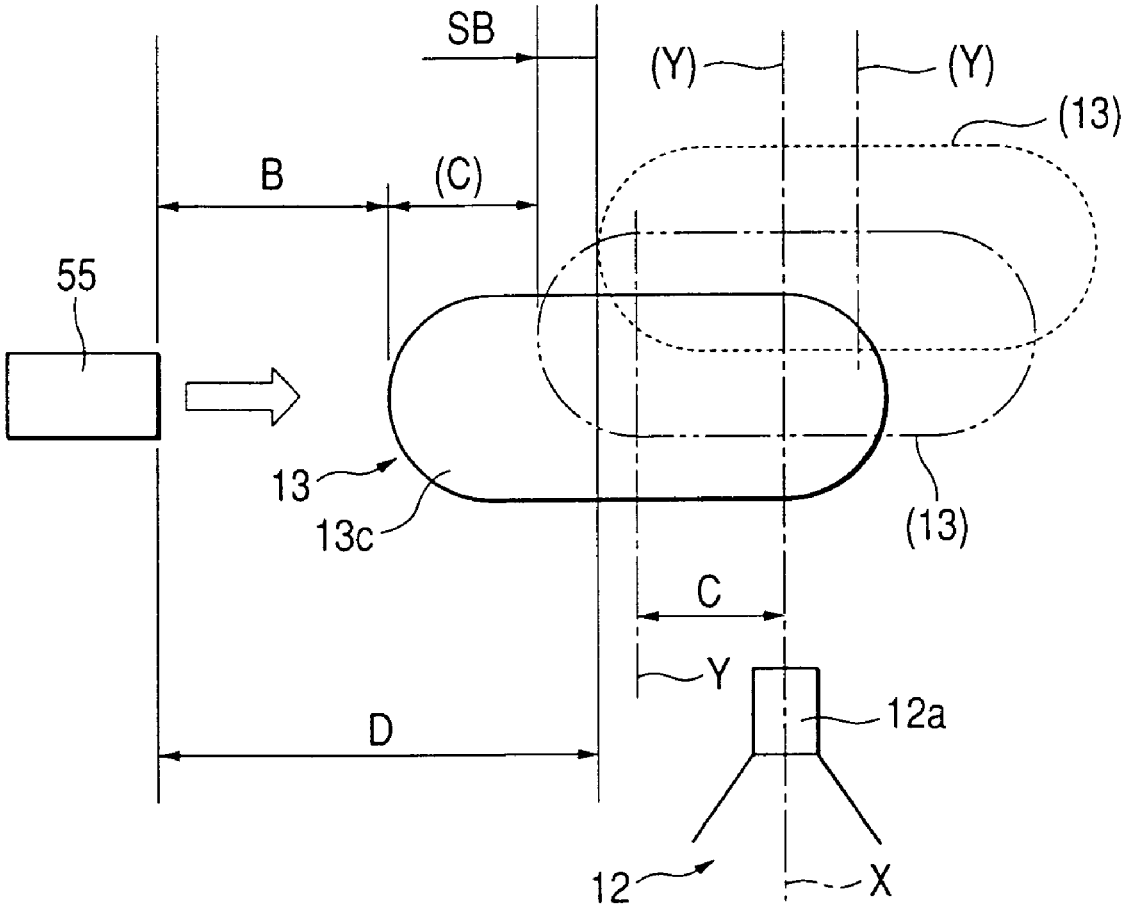
FIG. 5 is an illustration for explaining a principle for adjusting the off-axis positional difference (measured along a direction perpendicular to the center electrode axis) between the center electrode axis and center of the earth electrode.

The image processing unit 3 calculates the positional difference "C" as shown in FIG. 5 between the axis "X" of the center electrode 12 and center "Y" of the electrode 13.

An adjustment unit 5 connected with the image processing unit 3 causes the positional difference "C" to decrease by driving a motor through a motor controller 4.

The positional difference "C" as shown in FIG. 5 is defined by a distance between "X" and "Y" along a direction perpendicular to "X", when seen from the front of the tip surface 13*c*.

Figure 2:
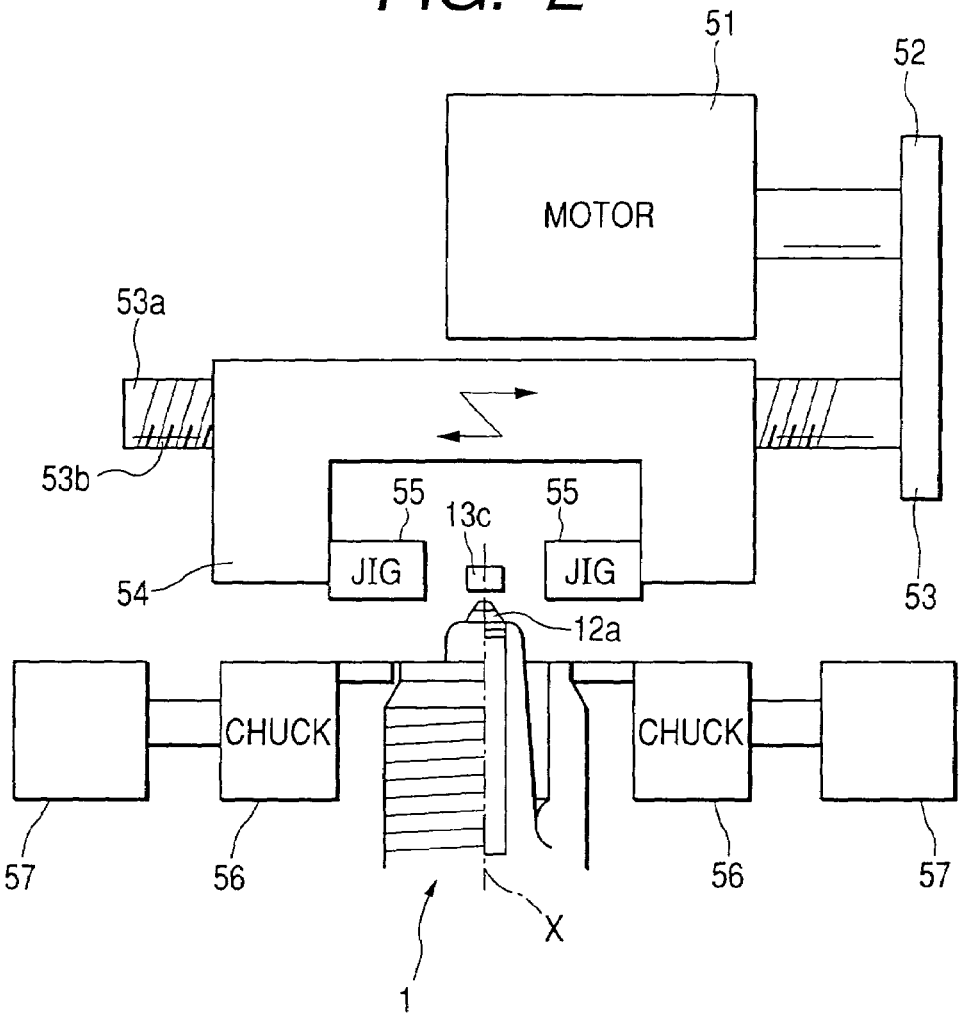
FIG. 2 is a conceptual elevational view of an adjustment unit included in the apparatus as shown in FIG. 1.

The positional difference between the two electrodes is adjusted by the motor control unit 4 which controls a motor 51 as shown in FIG. 2 of which rotation is transferred through a first gear 52 to a second gear 53 of which axis 53*a* is provided with a male screw 53*b*. The axis 53*a* is inserted into a holder 54.

The holder 54 is provided with a not-shown female screw, thereby moving the holder 54 along the right and left direction in accordance with the rotation direction of the motor 51. Further, the holder 54 is provided with two jigs 55 (disposed opposite at a prescribed distance) for alternately pushing the earth electrode 13.

Further, the adjustment unit 5 is provided with two chucks 56 for chucking the housing 10 of the spark plug 1 from both right and left sides. The chucks 56 are moved back and forth by hydraulic cylinder apparatus 57.

Figure 6:
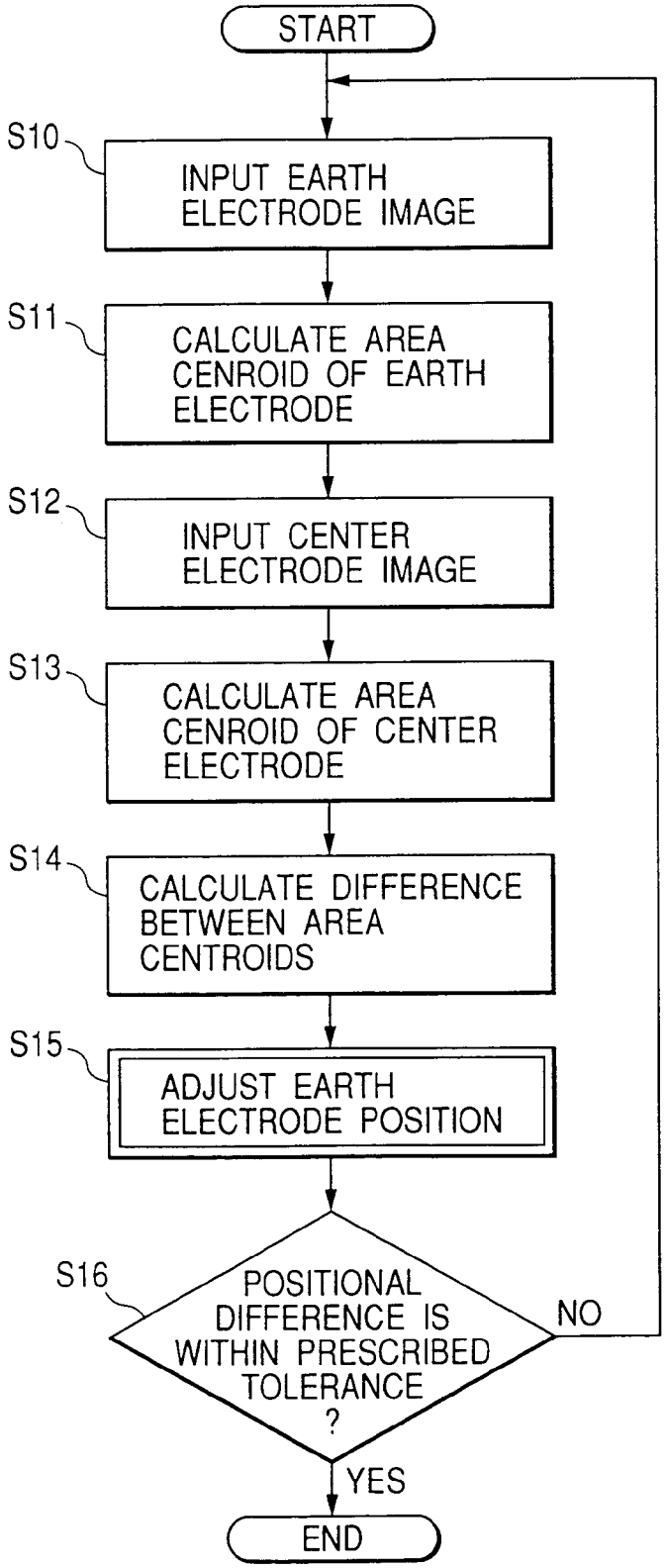
FIG. 6 is a flow chart for adjusting the off-axis position difference.

Next, the positional difference adjustment process is explained, referring to FIG. 6.

First, at S10, the image processing unit 3 inputs from the CCD camera 21 a picked-up image of the tip 13*c* of the earth electrode 13.

Then, at S11, the image processing unit 3 calculates an area center (centroid) of the tip surface 13*c* which is deemed to be the center of the area of the tip surface 13*c*. In the picked-up image as shown in FIG. 5, a polygonal outline of the tip surface 13*c* of which center is "Ye" decided by the edge processing method is expressed by solid lines, while its actual outline of which center is "Yr" is shown by a dotted line (one-dot chain line). Here, "Ye" is an equidistant point from the polygon vertexes. "Ye" actually differs from "Yr", depending upon the tip shape fluctuation. However, it was confirmed by the inventor that the difference between "Ye" and "Yr" becomes small if "Ye" is defined by the area centroid of the tip surface 13*c*.

Then, at S12, an image of the tip 12*a* of the center electrode 12 is inputted from the CCD camera 21 into the image processing unit 3.

Then, at S13, the image processing unit 3 calculates an area centroid of the tip 12*a* which is deemed to be the axis "X" of the center electrode 12.

Then, at S14, the difference "C" between "Y" ("Ye") and "X" is calculated.

Then, at S15, the earth electrode 13 is moved toward the axis of the center electrode 12 in order to decrease the difference "C".

Here, S15 is concretely explained, referring to FIG. 5.

First, a displacement "D" (=B+C+SB) of the jig 55 is calculated, where "B" is a distance (before moving the earth electrode 13) between the earth electrode and jig 55, "C" is a positional difference obtained at S14 and "SB" is a prescribed spring-back after the jig's returning back to its original position after having moved the earth electrode 13. In FIG. 5, the earth electrode 13 which was moved by "D" is shown by a dotted line (one dot chain line), while the earth electrode 13 which was moved back by the prescribed spring-back "SB" is shown by a two-dot chain line. Further, the above-mentioned two positions of the earth electrode 13 are shifted upward, respectively, for clearly illustrating the two positions.

After calculating the displacement "D", the jig 55 is moved by "D" by the motor 51 controlled by the motor controller 4, thereby moving the jig 55 to the position shown by the dotted line. Thereafter, the jig 55 is moved back to an original position by reversely rotating the motor 51. However, the earth electrode 13 is moved back to the position shown by the two-dot chain line as shown in FIG. 5.

Then, at S16, the positional difference "C" after completing the position adjustment at S15 is measured again. If "C" is determined to be within a prescribed tolerance, then the adjustment process is completed. On the other hand, if "C" is determined not to be within a prescribed tolerance, then, S10 to S15 are repeated.

In addition to the above-explained adjustment process steps, a chucking step for chucking the spark plug 1 may be executed, before illuminating the spark gap or before picking up the spark gap image.

What is claimed is:

1. A method for adjusting a positional relation between an earth electrode and a center electrode disposed away from the earth electrode through a spark gap, comprising:

providing a spark plug having a housing, the said center electrode extending along a center axis thereof and terminating distally in a tip portion having a tip surface, and the said earth electrode having one end portion fixed to said housing and an opposite end portion, said opposite end portion having a tip surface at a distal end thereof and having a side surface disposed in generally opposed facing relation to said tip surface of said center electrode through the spark gap;

measuring a positional difference between said center axis and a center of said tip surface of said earth electrode along a direction perpendicular to said center axis; and changing the positional relation between the earth electrode and the center electrode so as to reduce said measured positional difference.

2. The adjusting method according to claim 1, wherein said center of the tip surface of said earth electrode is an area centroid of the tip surface of said earth electrode.

3. The adjusting method according to claim 1, wherein the step of changing the positional relation includes moving the opposite portion of said earth electrode by a displacement including a prescribed spring-back.

4. The adjusting method according to claim 1, wherein the steps of measuring the positional difference and the step of changing the positional relation are repeated, if said positional difference is not within a prescribed tolerance.

5. The method according to claim 1, further comprising:

illuminating the tip portion of the center electrode and the tip surface of the earth electrode from a front of the tip surface of the earth electrode;

picking up a reflected image of both the illuminated tip portion of the center electrode and the illuminated tip surface of the earth electrode; and determining a position of the center of the tip surface of the earth electrode and a position of the center axis of the center electrode on the basis of the reflected image, the positional difference being measured on the basis of the determined positions.

6. The method according to claim 1, wherein at least one of the illuminating step or the picking-up step are preceded by a chucking step for chucking the spark plug.

7. The method according to claim 1, wherein the spark plug has a single earth electrode.

8. The method according to claim 1, wherein the step of changing the positional relation includes moving the second end portion of the earth electrode by a displacement including a prescribed spring-back.

9. A method of adjusting a positional relation between a cylindrical center electrode extending along its center axis and held within a housing of a spark plug while being insulated from the housing and an earth electrode which has a first end portion fixed to the housing and a second end portion having a side surface opposed to a tip surface of a tip portion of the center electrode through a spark gap, comprising:

measuring a positional difference between the center axis of the center electrode and a center of a tip surface of the second end portion of the earth electrode along a direction perpendicular to the center axis of the center electrode; and moving the second end portion of the earth electrode so as to reduce the positional difference.

10. The method according to claim 9, further comprising:

illuminating the tip portion of the center electrode and the tip surface of the earth electrode from a front of the tip surface of the earth electrode;

picking up a reflected image of both the illuminated tip portion of the center electrode and the illuminated tip surface of the earth electrode; and determining a position of the center of the tip surface of the earth electrode and a position of the center axis of the center electrode on the basis of the reflected image, the positional difference being measured on the basis of the determined positions.

11. The method according to claim 9, wherein the center of the tip surface of the earth electrode is an area centroid of the tip surface of the earth electrode.

* * * * *